United States Patent [19]

Turner

[11] 4,090,268

[45] May 23, 1978

[54] FOOT SUPPORT FOR SUNBATHERS

[76] Inventor: Jeanette A. Turner, P.O. Box 7204, Greensboro, N.C. 27407

[21] Appl. No.: 718,530

[22] Filed: Aug. 30, 1976

[51] Int. Cl.[2] ..... A47C 20/00

[52] U.S. Cl. ..... 5/327 R; 269/328

[58] Field of Search ..... 5/327, 338

[56] References Cited

U.S. PATENT DOCUMENTS

| | | | |
|---|---|---|---|
| 2,700,779 | 2/1955 | Tolkowsky | 5/338 |
| 3,234,623 | 2/1966 | Rector | 5/327 R |
| 3,345,654 | 10/1967 | Noble | 5/327 R |
| 3,345,656 | 10/1967 | Steinman | 5/338 |
| 3,924,282 | 12/1975 | Bond | 5/327 R |
| 3,931,654 | 1/1976 | Spann | 5/327 R |
| 3,981,030 | 9/1976 | Turner | 5/327 R |

*Primary Examiner*—Kenneth Downey

[57] ABSTRACT

A base member having an upper surface configuration and a pair of opposingly spaced, relatively small, vertical end abutments which, although very small and compact, cooperate to maintain the feet of a reclining sunbather in an upright position thereby ensuring proper orientation of the legs to obtain an even tan of the skin.

4 Claims, 5 Drawing Figures

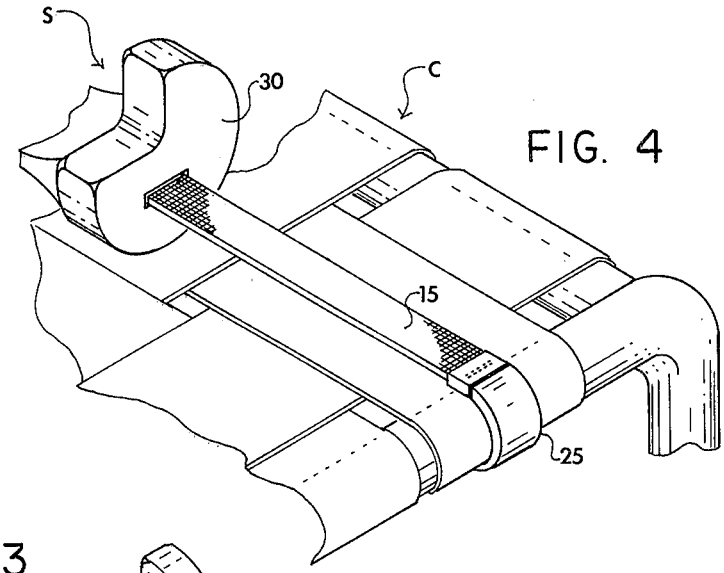
FIG. 4
FIG. 3
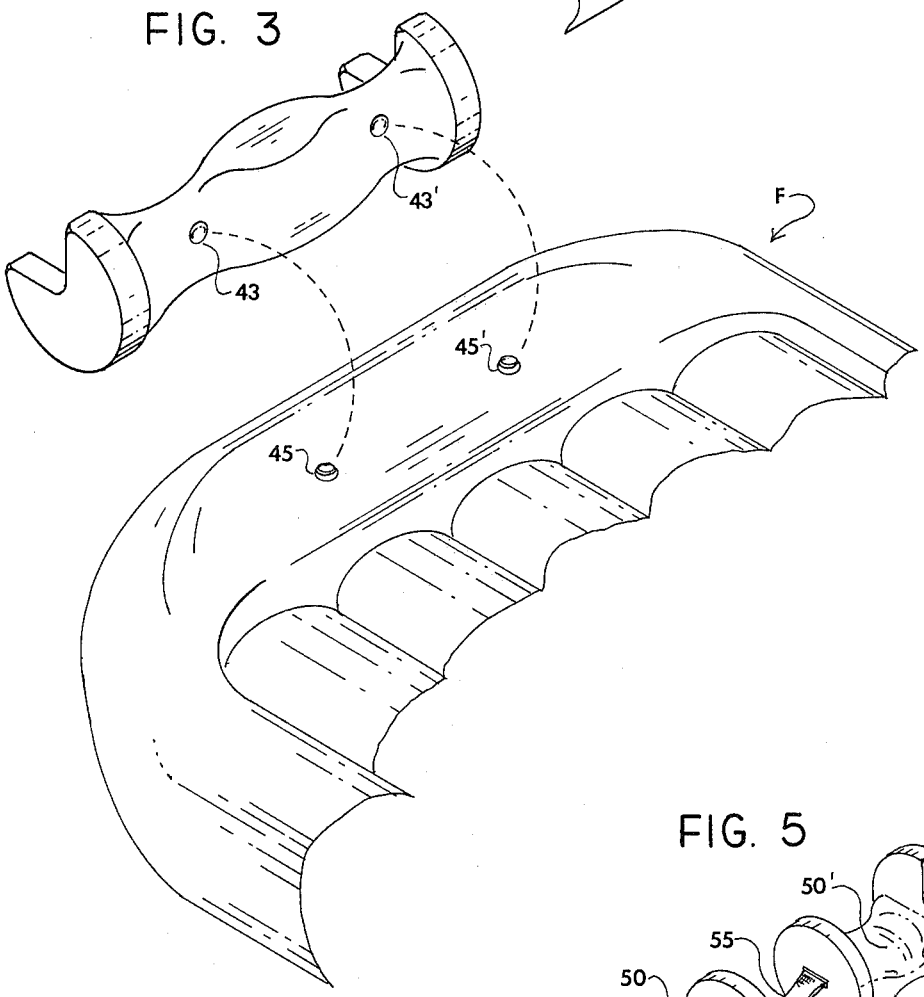
FIG. 5
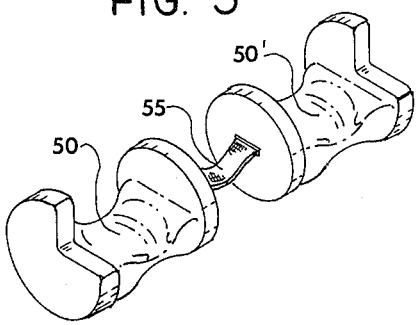

FOOT SUPPORT FOR SUNBATHERS

BACKGROUND OF THE INVENTION

Many people enjoy sunbathing, either for the general relaxation of the body provided by the warmth of the sun or for the pleasure derived from obtaining an even tan of the skin. For such people, sunbathing is a practice requiring numerous aids and appliances to ensure obtaining maximum benefit from the time spent in the sun. Many such aids have been manufactured including such devices as reflectors to direct the sun's rays to the body, special shields to protect certain areas of the body, headrests, mattresses, etc. However, to this inventor's knowledge, there is no device available specifically designed for supporting and maintaining the feet and legs in the proper orientation for obtaining an even tan of the legs when the body is in a reclining position.

The problem arises from the natural tendency when the body is in a reclined, relaxed position for the exposed portions of the feet and legs to turn outward. This outward turning prevents even tanning on the outer side areas of the legs and feet and, additionally, this normal body position is generally uncomfortable.

Toward this end, earlier attempts to solve this problem resulted in a device having a base with spaced end walls of such a height as to engage the outer edges of the feet up near the toes. The present invention constitutes an improvement to the earlier attempt disclosed in my co-pending application, Ser. No. 581,108 filed May 27, 1975, now U.S. Pat. No. 3,981,030 issued September 21, 1976. Further experimentation on the device disclosed therein revealed that by creating a cooperating relationship between the design of the upper surface of the base member and the opposing foot-supporting vertical abutments, one could obtain a more efficient and more easily fabricated foot support, while decreasing the overall size and weight.

SUMMARY OF THE INVENTION

The present invention is directed to an improved foot support for use while sunbathing and is of a configuration so designed as to support the feet in an upright or erect position between opposing vertical retaining walls or abutments of the support. Further, the support is so shaped as to effectively support the feet even where the sunbather is reclining on his stomach.

A preferred embodiment of the present invention is molded in one piece from a rigid plastic material, including a base member having a pair of spaced, saddle-like depressions on the upper surface thereof. Opposed retaining walls or abutments extend vertically upward from each end of the base member and are so designed and positioned with respect to said saddle members that they each engage an outer edge of the foot at a point slightly below and forwardly of the ankle bone thereof. It is then only necessary to place the rear of the ankles or heels in the saddle portion of the base between the foot supporting abutments and the feet are held upright. Additionally, in a preferred embodiment the abutments include a cutout or shelf-like portion which engages the outer bones of the ankle as a further support for the feet.

Further improvements include a means for removably attaching the foot support to a chaise lounge or onto a water float apparatus.

If desired, the molded apparatus may be formed in two separate pieces, one for each foot, and including a means for connecting the two foot supports so that a person may spread the supports apart as widely as is individually comfortable.

It is therefore an object of the present invention to provide an improved foot support for use during sunbathing to maintain the feet erect when the body is in a relaxed, reclined position.

It is a further object of the present invention to provide a sunbather's foot support which may be attached to a chaise lounge or water float apparatus.

Still further objects and uses of the invention will become apparent after the following detailed description is studied in conjunction with the accompanying drawings, of which:

FIG. 3 is a perspective view of an alternate embodiment of the present invention;

FIG. 4 is a perspective view of a second alternate embodiment of the present invention; and FIG. 5 is a perspective view of a third alternate embodiment of the present invention.

DETAILED DESCRIPTION OF THE PRESENT INVENTION

Figure 1:
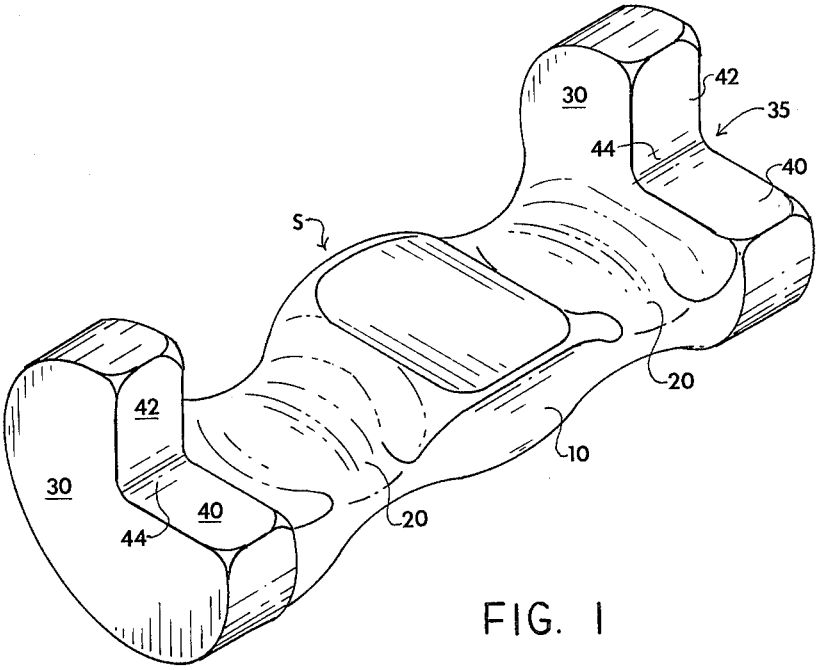
FIG. 1 is a perspective view of the device of the present invention made in accordance with a preferred embodiment.

The foot support S of FIG. 1, according to the preferred embodiment, is of an integrally formed construction, molded from any of the strong, rigid plastic materials. As discussed in my co-pending application Ser. No. 581,108, plastic is the preferred material, although others such as wood, rubber, or the like could be utilized.

In this preferred embodiment the support S has no moving parts and comprises an elongated base 10 having a pair of saddle-shaped foot supporting areas 20 on the upper surface thereof, and a pair of opposed foot retaining abutments 30 for holding the feet erect. Each of the saddle areas comprises an upturned parabolic shape along an imaginary longitudinal axis of the support and a downturned parabolic shape in a transverse direction, the two shapes merging to from a saddle shape substantially a hyperbolic paraballoid. The shape of the upper surface of base 10 and the shape as well as the positioning of abutments 30, were designed through an evolution of design configurations so that the feet are maintained upright due to a comfortable pressure against the outer surface of the rear portion of the fee in an area at least partially surrounding the ankle bone, while the ankles or heels are supported in a natural relaxed position in the saddle-shaped supports 20 as illustrated in FIG. 2.

Figure 2:
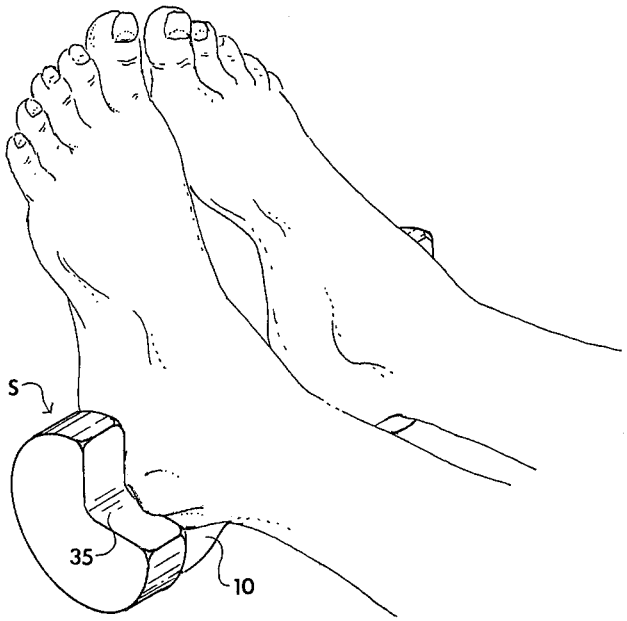
FIG. 2 is a perspective view of the device according to FIG. 1, in use.

A notched or cutout area 35, formed by a vertical wall 42 and a horizontal ledge 40 extending perpendicularly from the base 44 of vertical wall 42 is preferably formed within each abutment 30 and is strategically positioned to comfortable support the portion of the foot surface just forward of the ankle bone while providing a void space into which the ankle bone itself may protrude, as illustrated in FIG. 2. The angle defined by walls 40,42 of the notched area 35 is approximately 90° with ledge 40 lying in a plane approximately parallel to the upper surface of the base 10, and at such a distance therefrom as to provide support for the ankle bone, when occupied.

In the illustrated embodiments, the space between the abutments 30 is approximately 7 to 8 inches which is generally the average combined width of the feet of an average sized, barefoot, female adult. The front to rear dimension of base 10 is approximately 3 inches. However, this dimension is not critical, it only being necessary for the saddle area to comfortably support the rear surface of the foot in the Achilles tendon area. It should be noted that the design of the support S is equally effective whether the sunbather is reclining on stomach or back, as the saddle and abutments cooperate equally well with the instep or the portion of the foot behind the ankle.

For those people who prefer sunbathing while reclined on a chaise lounge C or upon a floating apparatus F, rather than at poolside or on the beach, foot support S may be attached to the chaise or float as illustrated in FIGS. 3 and 4. One means for accomplishing this is by the attachment of a strap 15 of fabric or elastic secured at one end to the outer side of each abutment 30, and a plastic or metal clip 25 on the other end. In use the clips 25 are snapped around opposing sides of the frame of the chaise lounge C. Where the band 15 is elastic, it will stretch to fit various sizes of lounge chairs.

For use on a float, snap components 43, 43' may be added to the support and correspondingly to the float F at 45, 45' so that the support S may be snapped into place as desired. Additionally, the support S could be provided as an inflatable device (not shown) for use with rubberized or other inflatable floating apparatus.

A third embodiment, illustrated in FIG. 5, is specifically directed to a device which may be used by a larger person or one who desires to spread his feet apart but still utilize the support. In this embodiment, support S includes two separate halves 50, 50' connected by a cord 55. The configuration of the heel or ankle support and abutment members remains the same as in the preferred embodiment.

Various other changes and modifications may be made to the embodiments herein described without departing from the scope of the invention which is limited only by the following claims.

What is claimed is:

1. A foot support for sunbathers comprising:

a. an elongated base member having an upper contoured surface;

b. a pair of spaced saddle portions formed in said upper surface adjacent each end thereof and extending transversely therethrough, each of said saddle portions including a curved surface so shaped as to form a series of connected parabolas being upturned along the longitudinal axis of said base member and downturned in a direction transverse to the longitudinal axis;

c. a pair of foot supporting abutments extending vertically upward from opposing ends of said base member immediately adjacent said saddle portions;

d. each of said abutments including a cutout therein defined by a vertical wall and a horizontal ledge extending perpendicularly from the base of said vertical wall, said horizontal ledge being spaced above said upper surface of said saddle portion a distance such as to support said ankle bone when occupied and said vertical dimension of said abutment and said dimensions of said cutout being such that, when occupied, said foot supporting abutment engages the outer surface of the rear portion of the foot in an area at least partially surrounding the ankle bone;

e. said foot supporting abutment being spaced apart a distance substantially equal to the combined width of the feet of a normally sized sunbather;

f. whereby when positioned in said support, the feet are maintained in a position perpendicular to the ground and the legs are maintained in a position permitting even exposure to the sun.

2. A foot support according to claim 1 further including means for attaching said support to a chaise lounge.

3. A foot support according to claim 1 further including means for attaching said support to a water float apparatus.

4. A foot support according to claim 1 wherein said elongated base member is separated between said saddle portions, whereby said foot supporting member is divided into two separate, individually positionable, foot-supporting segments.

* * * * *